US005438340A

United States Patent [19]

Fukuzawa et al.

[11] Patent Number: 5,438,340

[45] Date of Patent: Aug. 1, 1995

[54] ELLIPTICAL FEEDHORN AND PARABOLIC REFLECTOR WITH PERPENDICULAR MAJOR AXES

[75] Inventors: Keiji Fukuzawa, Chiba; Yoshikazu Yoshida, Tokyo, both of Japan

[73] Assignee: Sony Corporation, Tokyo, Japan

[21] Appl. No.: 252,976

[22] Filed: Jun. 2, 1994

Related U.S. Application Data

[63] Continuation of Ser. No. 897,473, Jun. 12, 1992, abandoned.

[51] Int. Cl.[6] ..... H01Q 13/02; H01Q 19/13

[52] U.S. Cl. ..... 343/781 R; 343/756; 343/786; 343/840

[58] Field of Search ..... 343/756, 781 R, 786, 343/840; H01Q 19/10–19/15, 13/00, 13/02, 15/14, 15/16, 19/17

[56] References Cited

U.S. PATENT DOCUMENTS 5,043,683 8/1991 Howard ..... 343/786

FOREIGN PATENT DOCUMENTS 0071069 2/1983 European Pat. Off. ..... 343/700 MS
2552273 3/1985 France ..... 343/700 MS
0193105 11/1982 Japan ..... 343/786
0203003 10/1985 Japan ..... 343/786
610360 10/1948 United Kingdom ..... 343/781 R

OTHER PUBLICATIONS

Foldes, "A Synthesis Method for Shaped Beam Spacecraft Communications Antennas", Conference, 1970 G-AP International Symposium, Columbus, Ohio, USA (14–16 Sep. 1970), pp. 9–12.

*Primary Examiner*—Michael C. Wimer
*Attorney, Agent, or Firm*—Jay H. Maioli

[57] ABSTRACT

A parabolic-reflector antenna having a primary horn including first, second, and third hollow portions. The first hollow portion has an elliptical aperture on one end thereof and a circular cross section on an opposite end thereof, and is progressively tapered away from the elliptical aperture. The second hollow portion has a circular cross section and a constant diameter, and is joined to the opposite end of the first hollow portion. The third hollow portion has a circular cross section on one end thereof and a circular cross section on an opposite end thereof. The third hollow portion is joined to the opposite end of the second hollow portion, and is progressively tapered away from the second hollow portion. The parabolic-reflector antenna also includes a parabolic reflector having an elliptical aperture whose major axis is perpendicular to the major axis of the elliptical aperture of the primary horn.

8 Claims, 5 Drawing Sheets

ELLIPTICAL FEEDHORN AND PARABOLIC REFLECTOR WITH PERPENDICULAR MAJOR AXES

This is a continuation of application Ser. No. 07/897,473 filed Jun. 12, 1992, now abandoned.

BACKGROUND OF THE INVENTION

1. Field of the Invention

The present invention relates to a parabolic-reflector antenna for receiving satellite broadcasts, and more particularly to a primary horn for use in such a parabolic-reflector antenna.

2. Description of the Prior Art

Parabolic-reflector antennas are used to receive satellite broadcasts. As shown in FIG. 1 of the accompanying drawings, one conventional parabolic-reflector antenna comprises a parabolic reflector 1 for reflecting an incoming radio wave, and a polarization converter 2 for converting the radio wave reflected by the parabolic reflector 1 from circular polarization into linear polarization. The parabolic reflector 1 is of a circular shape (i.e., a circular aperture) as viewed from the broadcasting satellite. The polarization converter 2 comprises a primary horn which also has a circular aperture for guiding the radio wave reflected by the parabolic reflector 1 to a polarization converting system.

Since the conventional parabolic-reflector antenna has the parabolic reflector 1 of a circular aperture, if the parabolic-reflector antenna faces a plurality of broadcasting satellites that are located relatively close to each other, it tends to receive radio waves from those broadcasting satellites which the antenna is not aimed at.

OBJECTS AND SUMMARY OF THE INVENTION

In view of the foregoing difficulty of the conventional parabolic-reflector antenna, it is an object of the present invention to provide a primary horn for a parabolic-reflector antenna which is capable of receiving radio waves from a desired broadcasting satellite even if there are other broadcasting satellites positioned relatively close to the desired broadcasting satellite.

According to the present invention, there is provided a primary horn for use with a parabolic-reflector antenna, comprising a first hollow portion having an elliptical aperture on one end thereof and a circular cross section on an opposite end thereof, the first hollow portion being defined by an inner surface which is progressively tapered from one end toward the other end.

The primary horn further includes a third hollow portion having a circular cross section on one end thereof and a circular cross section on an opposite end thereof, the third hollow portion being defined by an inner surface which is progressively tapered from one end toward the other end, the first and third hollow portions being held coaxially with each other in axially juxtaposed relationship to each other.

The primary horn also has a second hollow portion having a circular cross section and a constant diameter from one end thereof to an opposite end thereof, the one end of the second hollow portion being joined to the opposite end of the first hollow portion, the opposite end of the second hollow portion being joined to one end of the third hollow portion.

The above and other objects, features, and advantages of the present invention will become apparent from the following description of an illustrative embodiment thereof to be read in conjunction with the accompanying drawings, in which like reference numerals represent the same or similar objects.

DETAILED DESCRIPTION OF THE PREFERRED EMBODIMENT

Figure 1:
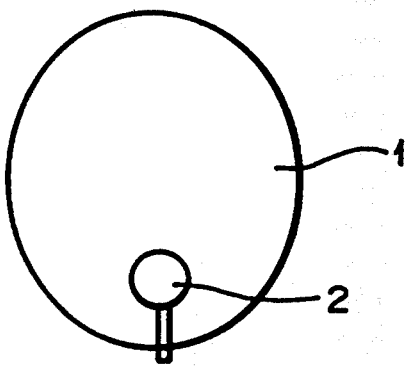
FIG. 1 (PRIOR ART)
FIG. 1 is a front elevational view of a conventional parabolic-reflector antenna.
Figure 2:
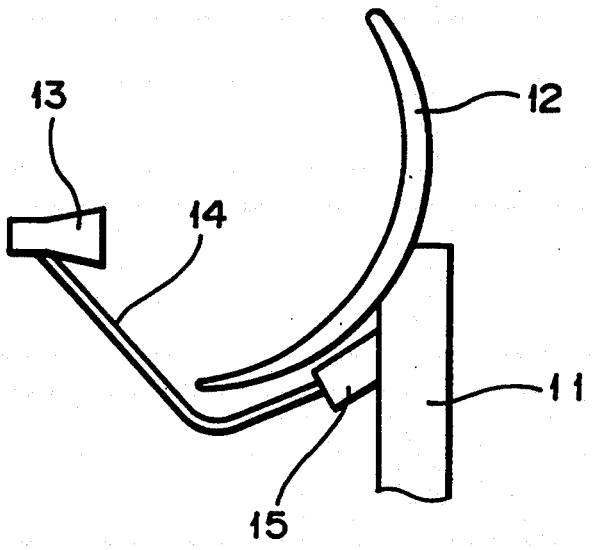
FIG. 2 is a side elevational view of a parabolic-reflector antenna having a polarization converter including a primary horn according to the present invention.

FIG. 2 shows a parabolic-reflector antenna having a polarization converter including a primary horn according to the present invention.

As shown in FIG. 2, the parabolic-reflector antenna comprises a parabolic reflector 12 mounted on a support column 11, and a polarization converter 13 positioned at the focal point of the parabolic reflector 12 so that radio waves reflected by the parabolic reflector 12 are concentrated on the polarization converter 13. The polarization converter 13 is connected to a signal converter 15 by a waveguide 14.

When the parabolic reflector 12 is directed toward a broadcasting satellite, a circularly polarized radio wave transmitted from the broadcasting satellite is reflected toward the polarization converter 13 by the parabolic reflector 12. The polarization converter 13 converts the circularly polarized radio wave into a linearly polarized radio wave, which is guided to the signal converter 15 by the waveguide 14. The signal converter 15 converts the linearly polarized radio wave into an electric signal that is sent to a tuner (not shown).

Figure 3:
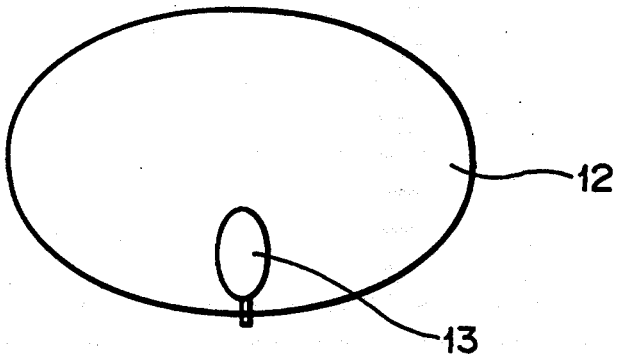
FIG. 3 is a front elevational view showing the orientations of elliptical shapes of the polarization converter and a parabolic reflector of the antenna shown in FIG. 2.

As shown in FIG. 3, the parabolic reflector 12 comprises a reflector having an elliptical aperture with a horizontal major axis. Because of the horizontal major axis, the parabolic reflector 12 has high horizontal directivity. If many broadcasting satellites are positioned relatively close to each other, then the parabolic reflector 12 with high horizontal directivity is able to reliably receive radio waves from a desired one of the broadcasting satellites.

The parabolic reflector 12 with high horizontal directivity has low vertical directivity. To compensate for the reduction in the vertical directivity of the parabolic reflector 12, the polarization converter 13 has a primary horn for receiving radio waves reflected by the parabolic reflector 12, the primary horn having an elliptical aperture with a vertical major axis, as described later on.

Radio waves transmitted from broadcasting satellites are circularly polarized so that antennas for receiving the radio waves from the broadcasting satellites can easily be installed without concern over the planes of polarization of the radio waves. However, since circularly polarized radio waves cannot efficiently be converted into electric signals, they are first converted into linearly polarized radio waves by the polarization converter 13 for subsequent conversion into electric signals.

The polarization of circularly polarized radio waves is rotating clockwise or counterclockwise in order to prevent radio waves transmitted by two broadcasting satellites that are located relatively closely to each other from interfering with each other. For example, if the polarization of circularly polarized radio waves transmitted by a broadcasting satellite of Japan is rotating clockwise, and a broadcasting satellite of Korea is positioned in the vicinity of the broadcasting satellite of Japan, then the polarization of circularly polarized radio waves transmitted by the broadcasting satellite of Korea is rotating counterclockwise so that the radio waves transmitted by the broadcasting satellite of Korea will not interfere with Japan's radio waves and the radio waves transmitted by the broadcasting satellite of Japan will not interfere with Korea's radio waves.

The elliptical aperture of the parabolic reflector 12 shown in FIG. 3 is however ineffective to discriminate clearly between the clockwise and counterclockwise rotating polarizations. For example, even when the parabolic reflector 12 is supposed to receive circularly polarized radio waves whose polarization is rotating clockwise (or counterclockwise), it also receives circularly polarized radio waves whose polarization is rotating counterclockwise (or clockwise). The same problem arises with respect to discriminating between vertically linearly polarized radio waves and horizontally linearly polarized radio waves. Therefore, parabolic reflector 12 with the elliptical aperture has poor cross polarization discrimination.

Figure 4:
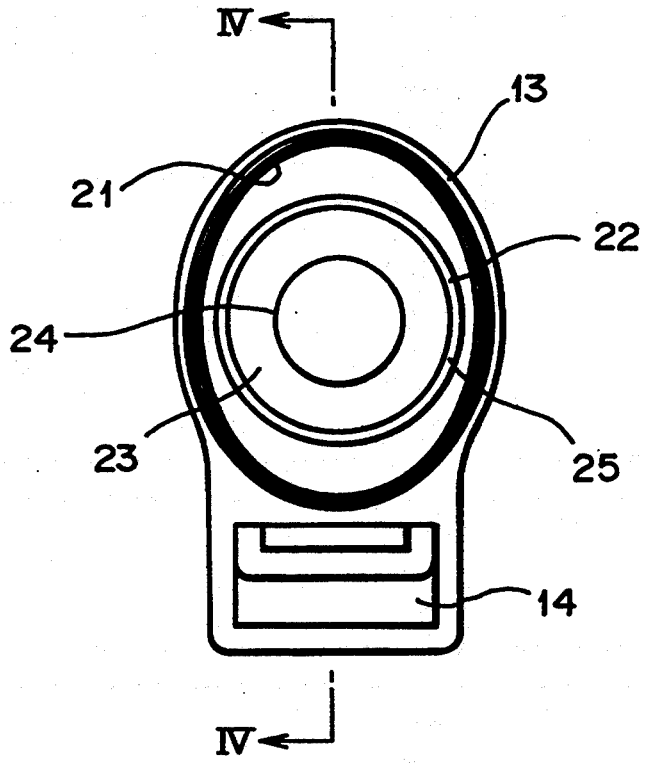
FIG. 4 is a front elevational view of the polarization converter.
Figure 5:
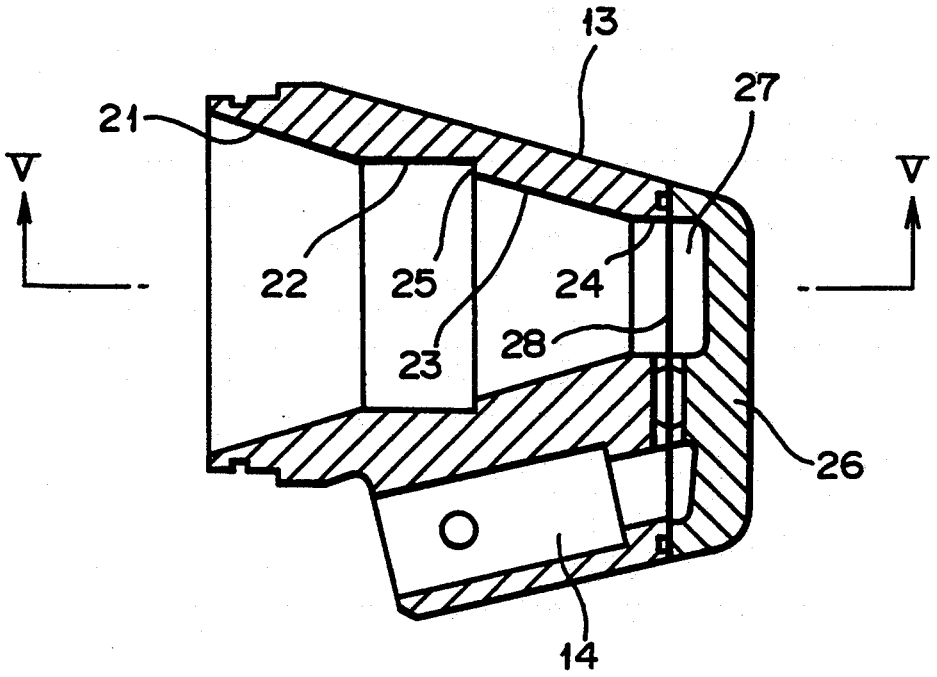
FIG. 5 is a cross-sectional view taken along line IV—IV of FIG. 4.
Figure 6:
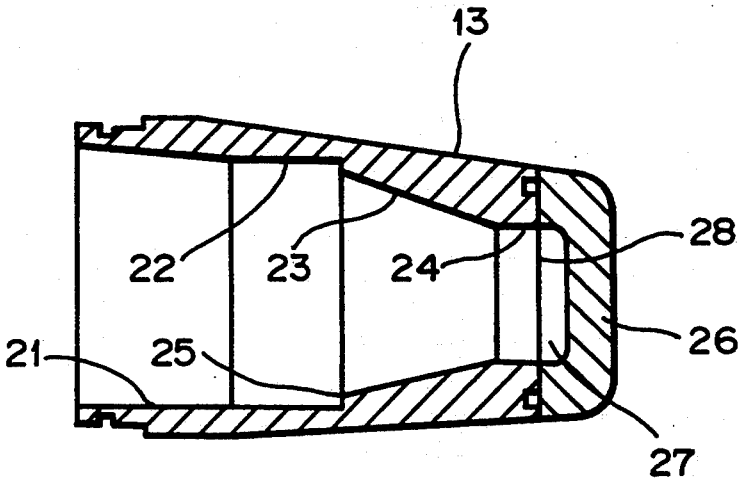
FIG. 6 is a cross-sectional view taken along line V—V of FIG. 5.

To improve the cross polarization discrimination of the parabolic reflector 12, the primary horn of the polarization converter 13 comprises a dual-mode horn having a vertically elongate elliptical aperture, as shown in FIGS. 4 through 6.

More specifically, the primary horn for receiving radio waves reflected by the parabolic reflector 12 is composed of three successive hollow portions 21, 22, 23 defined by respective inner surfaces. The first portion 21, which is elliptical in cross section, has an elliptical aperture on one end having a vertical major axis and a horizontal minor axis. Thus, the orientation of the elliptical aperture of the portion 21 is perpendicular to the orientation of the elliptical aperture of the parabolic reflector 12 shown in FIG. 3.

The inner surface of the first portion 21 is progressively tapered to a smaller diameter in a direction away from its aperture. The innermost end of the first portion 21 is of a circular cross section and joined to the outermost end of the second portion 22 which is circular in cross section and has a constant diameter. The joined ends of the first and second portions 21, 22 are of the same diameter. The innermost end of the second portion 22 is in turn joined to the outermost end of the third portion 23 which is circular in cross section and progressively tapered to a smaller diameter away from the second portion 22. The innermost end of the second portion 22 is larger in diameter than the outermost end of the third portion 23. A step 25 is interposed between the second and third portions 22, 23. The first, second, and third portions 21, 22, 23 are held substantially coaxial with each other in axially juxtaposed relationship to each other.

The innermost end of the third portion 23 is joined to a waveguide 24 having a constant diameter. An end plate 26 having a recess 27 defined therein is joined to the innermost end of the waveguide 24. The waveguide 24 and the recess 27 jointly provide a space in which a film substrate 28 is disposed. As shown in FIG. 5, the film substrate 28 has a probe 31 (see FIG. 7) positioned in confronting relationship to the waveguide 24, and another probe 35 positioned in confronting relationship to the waveguide 14.

The dual-mode horn configuration of the primary horn is effective to generate a high-order mode of electric field for improving the cross polarization discrimination. For example, if circularly polarized radio waves whose polarization is rotating counterclockwise are received, the primary horn suppresses circularly polarized radio waves whose polarization is rotating clockwise. The primary horn is thus capable of compensating the reduction in the cross polarization discrimination which is caused by the elliptical aperture of the parabolic reflector 12.

Figure 7:
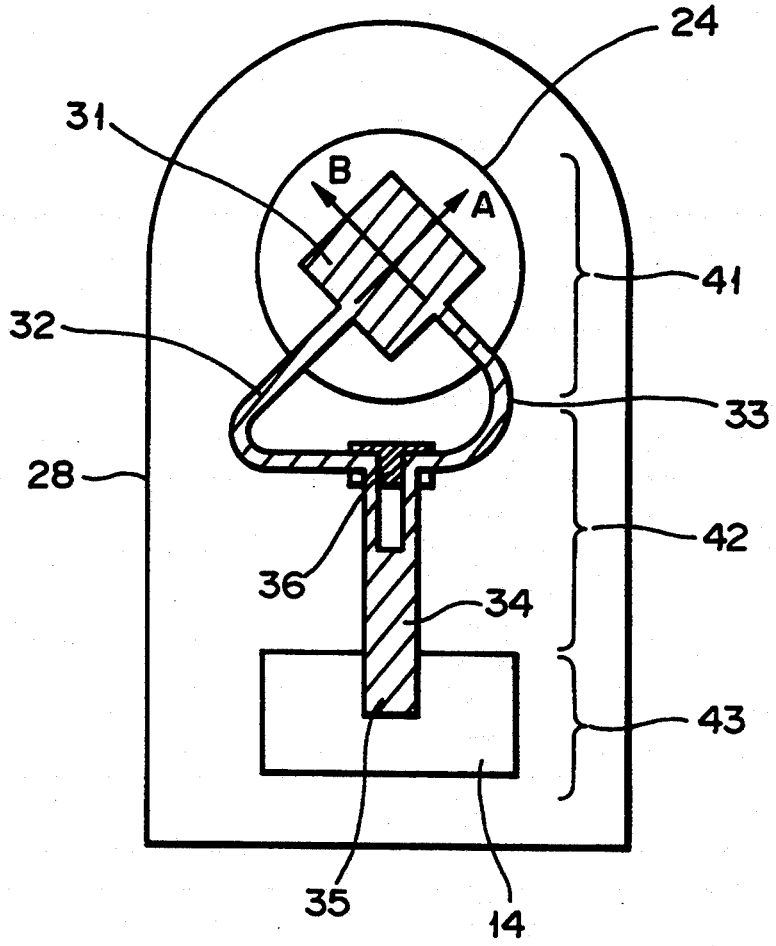
FIG. 7 is an enlarged front elevational view of a pattern on a film substrate in the primary horn shown in FIGS. 5 and 6.

FIG. 7 shows a pattern on the film substrate 28. The film substrate 28, which is flexible and highly thin, has the probe 31, branches 32, 33, a coupling 34, and the probe 35 that are internally formed of aluminum foil as a continuous pattern. The branches 32, 33 and the coupling 34 jointly make up a suspended line 42. The probe 31 serves as a converting section 41 for converting a waveguide mode into a suspended line mode, and the probe 35 serves as a converting section 43 for converting a suspended line mode into a waveguide mode.

The probe 31 is of a substantially square shape and positioned in confronting relationship to (i.e., within the waveguide passage of) the waveguide 24. The square probe 31 has two adjacent perpendicular sides to which ends of the respective branches 32, 33 are joined. The branch 32 is longer than the branch 33 such that their transmission line lengths differ from each other by $\frac{1}{4}$ of the wavelength $\lambda$ of the received radio wave. The other ends of the branches 32, 33 are joined to each other by the coupling 34. The coupling 34 is connected to the probe 35, which is positioned within (i.e., within the waveguide passage of) the waveguide 14. A printed resistor 36 is interposed between the branches 32, 33. The pattern thus formed on the film substrate 23 serves as a Wilkinson type combiner.

In Japan, radio waves transmitted by the broadcasting satellites are circularly polarized with the clockwise rotating polarization. The circularly polarized radio waves are composed of a combination of two electric fields directed at a right angles with respect to each other, with one electric field leading the other by 90°. The branch 32, which is $\lambda/4$ longer than the branch 33, detects the electric field, indicated by the arrow A in FIG. 7, that leads the other electric field by 90°, whereas the branch 33 detects the electric field, indicated by the arrow B in FIG. 7, that lags the other electric field by 90°. Since the branch 32 is $\lambda/4$ longer than the branch 33, the electric field which is detected by the branch 32 reaches the coupling 34 with a delay of 90° with respect to the electric field which is detected by the branch 33. Therefore, when the electric fields reach the coupling 34, they are in phase with each other. The coupling 34 and hence the probe 35 joined thereto detect and output a linearly polarized radio wave, which is then propagated through the waveguide 14 and supplied to the signal converter 15. The signal converter 15 converts the supplied linearly polarized radio wave into an electric signal.

The pattern formed on the film substrate 28 as shown in FIG. 7 is capable of receiving some circularly polarized radio waves with the counterclockwise rotating polarization as well as the circularly polarized radio waves with the clockwise rotating polarization. Such circularly polarized radio waves with the counterclockwise rotating polarization are however suppressed by the printed resistor 36 interposed between the branches 32, 33. The inclusion of the printed resistor 36, together with the dual-mode horn configuration, serves to improve the cross polarization discrimination.

Having described a preferred embodiment of the invention with reference to the accompanying drawings, it is to be understood that the invention is not limited to that precise embodiment and that various changes and modifications could be effected by one skilled in the art without departing from the spirit or scope of the invention as defined in the appended claims.

What is claimed is:

1. A parabolic-reflector antenna comprising:

a support column;

a parabolic reflector mounted on said support column and having an elliptical shape with a horizontal major axis;

a polarization converter mounted on said support column including a primary horn mounted in an opposing relationship with respect to said parabolic reflector for receiving radio waves reflected by said parabolic reflector, said primary horn comprising a first hollow portion having:

an elliptical cross section with a vertical major axis perpendicular to the horizontal major axis of said parabolic reflector at a first end of said first hollow portion for discriminating between cross polarized waves;

a circular cross section of a first diameter at an opposite second end of said first hollow portion; and a first inner surface which is progressively tapered from said first end of said first hollow portion to said opposite second end of said first hollow portion;

converting means mounted coaxially with respect to said first hollow portion of said primary horn for converting a circularly polarized radio wave into a linearly polarized radio wave; and a waveguide connected to said converting means for guiding said linearly polarized radio wave converted by said converting means to a selected location.

2. A parabolic-reflector antenna according to claim 1, wherein said primary horn further comprises a second hollow portion and a third hollow portion, said third hollow portion having:

a circular cross section of a second diameter at a first end of said third hollow portion;

a circular cross section of a third diameter at an opposite second end of said third hollow portion; and a second inner surface progressively tapered from said first end of said third hollow portion to said opposite second end of said third hollow portion, said first hollow portion and said third hollow portion being connected by said second hollow portion and being positioned coaxially with respect to each other.

3. A parabolic-reflector antenna according to claim 2, wherein said second hollow portion has:

a constant circular cross section of a fourth diameter from a first end of said second hollow portion to an opposite second end of said second hollow portion, said first end of said second hollow portion being joined to said opposite second end of said first hollow portion, and said opposite second end of said second hollow portion being joined to said first end of said third hollow portion.

4. A parabolic-reflector antenna according to claim 3, wherein said first diameter of said circular cross section at said opposite second end of said first hollow portion and said fourth diameter of said constant circular cross section of said second hollow portion are the same.

5. A parabolic-reflector antenna according to claim 3, wherein said fourth diameter of said constant circular cross section of said second hollow portion is larger than said second diameter of said circular cross section at said first end of said third hollow portion.

6. A parabolic-reflector antenna according to claim 5, further comprising a step interposed between said opposite second end of said second hollow portion and said first end of said third hollow portion.

7. A parabolic-reflector antenna according to claim 3 wherein:

said converting means for converting a circularly polarized radio wave into a linearly polarized radio wave and said waveguide connected to said converting means for guiding said linearly polarized wave converted by said converting means to said selected location are connected to said third hollow portion.

8. A parabolic-reflector antenna comprising:

a support column;

a parabolic reflector mounted on said support column and having an elliptical shape with a horizontal major axis;

a polarization converter mounted on said support column including a primary horn mounted in an opposing relationship with respect to said parabolic reflector for receiving radio waves reflected by said parabolic reflector, said primary horn comprising a first hollow portion having an elliptical cross section with a vertical major axis perpendicular to the horizontal major axis of said parabolic reflector at a first end of said first hollow portion, a circular cross section of a first diameter at an opposite second end of said first hollow portion, and a first inner surface progressively tapered from said first end to said opposite second end of said first hollow portion;

a second hollow portion having a constant circular cross section of said first diameter from a first end to an opposite second end of said second hollow portion; and a third hollow portion having a circular cross section of a second diameter at a first end of said third hollow portion, a circular cross section of a third diameter at an opposite second end of said third hollow portion and a second inner surface progressively tapered from said first end to said opposite second end of said third hollow portion, wherein said opposite second end of said first hollow portion is connected to said first end of said second hollow portion and said opposite second end of said second hollow portion is connected to said first end of said third hollow portion;

converting means connected to said third hollow portion for converting a circularly polarized radio wave into a linearly polarized radio wave; and a waveguide connected to said converting means, for guiding said linearly polarized radio wave converted by said converting means to a selected location.

* * * * *